United States Patent [19]

Lossa

[11] 4,422,597

[45] Dec. 27, 1983

[54] CARRIER DEVICE FOR TWISTER OR BOBBIN TUBES

[75] Inventor: Ulrich Lossa, Krefeld, Fed. Rep. of Germany

[73] Assignee: Palitex Project-Company GmbH, Krefeld, Fed. Rep. of Germany

[21] Appl. No.: 320,855

[22] Filed: Nov. 13, 1981

[30] Foreign Application Priority Data

Dec. 10, 1980 [DE] Fed. Rep. of Germany ..... 3046449

[51] Int. Cl.[3] ..... B65H 49/00

[52] U.S. Cl. ..... 242/130; 242/128

[58] Field of Search ..... 242/128, 129.5, 130, 242/134; 57/127.5, 127.7, 345–349, 58.54, 58.55, 58.52

[56] References Cited

U.S. PATENT DOCUMENTS 2,647,704 8/1953 Samler et al. ..... 242/128

4,067,180 1/1978 Bleeck ..... 57/58.52

*Primary Examiner*—Leonard D. Christian

[57] ABSTRACT

A carrier device for at least two twister or bobbin tubes (4, 17) disposed axially one above the other, comprising a substantially sleeve-shaped carrier member whose bottom end has a radially outwardly directed support surface (3) for supporting the lower tube (4). Disposed in the central region of the carrier member is a support surface (12) whose circumference is smaller than the inner circumference of the lower tube (4) to enable the latter tube (4) to be slipped onto the carrier body over the support surface 12. An annular or disc-shaped pull-off aid (13), which is preferably mounted so as to be freely rotatable, is slipped onto the support surface (12) and ensures that the threads from the tubes are not damaged when they are drawn off overhead, and that excessive stressing of the threads is avoided.

10 Claims, 3 Drawing Figures

CARRIER DEVICE FOR TWISTER OR BOBBIN TUBES

BACKGROUND AND OBJECTIVES OF THE INVENTION

The invention relates to a carrier device for yarn or thread carrying twister or bobbin tubes or use, for example in a yarn or thread processing machine.

Such carrier devices are known wherein at least two such tubes are disposed axially, one above the other, on a substantially sleeve-shaped carrier member whose bottom end has a radially outwardly directed support surface and which, together with the tubes, is transportable as a unit.

Carrier devices of this kind are described in, for example, British Pat. specification No. 11 31 699 (German 1560257) and serve to facilitate the insertion of fully wound twister or bobbin tubes into the yarn or thread processing machine, and also enable the bobbins to be stored or collected along side the machine. The machine operator need only have bobbin units handy which contain the collected bobbins, so that, even after the double bobbin unit with the carrier device has been inserted into the yarn or thread processing machine, it is only necessary to thread the previously united threads of the two bobbins with a minimum of manipulations on the machine.

In the case of double bobbin units of this kind having a common carrier device, the individual threads of the two bobbins are generally drawn off overhead. In the known carrier device described in British Pat. specification No. 11 31 699, when the two bobbins or tubes are placed one on top of the other, the lower bobbin or tube is supported on the lower, radially outwardly directed support surface of the carrier member while the upper bobbin or tube placed onto the carrier member is supported by the lower tube.

In various yarn and thread processing machines, such as double twist machines, it is already known to place a double arrangement of two bobbins directly onto a machine part, such as a bobbin carrier, forming a part of the yarn or thread processing machine. In this connection, it is known from, for example, German Offenlegungsschrift 15 10 976, to use disc-shaped pull-off aids which are disposed of either between the two bobbins placed one above the other, or above the upper bobbin, in order to prevent, as far as possible, the thread from sliding along the bobbins when the thread is being drawn off. Pull-off aids of this kind can be either rigid guide discs, or alternatively, resilient guide discs.

In the case of a double twist machine with a single bobbin placed onto the bobbin carrier, it is known from, for example, German Auslegeschrift 12 27 811, to rotatably mount a resilient guide disc above the bobbin by means of ball bearings. This rotatably mounted guide disc is rotated by the thread sliding along its outer circumference.

An object of the present invention is to provide a carrier device for at least two twister or bobbin tubes, placed axially one above the other, such that it is possible to mount an associated disc-shaped pull-off aid without impairing the slipping-on of the lower tube and of an upper tube.

In accordance with the present invention, the carrier device includes a support surface which is located in the central region of the carrier member and whose circumference is smaller than the inner circumference of the lower twister or bobbin tube to enable the latter tube to be slipped onto the carrier member, and an annular or disc-shaped pull-off aid which is slipped onto, or can be slipped onto, the latter support surface.

In disassembling a carrier device constructed in this manner, the pull-off aid can be removed upwardly from the carrier member, and the lower twister tube or bobbin can then be removed over the pull-off aid support surface. In assembling the device, after the lower tube or bobbin has been slipped on or mounted, the annular or disc-shaped pull-off aid can be slipped onto the carrier member until it abuts against the support surface. The upper tube or bobbin is then slipped on. Preferably, the support surface for the pull-off aid is shaped such that the pull-off aid is located at a distance above the lower twister or bobbin tube.

SUMMARY OF THE INVENTION

In a preferred embodiment of the invention, the carrier member has a lower cylindrical portion and an upper portion of smaller diameter than the lower cylindrical portion, whereby the circumference of the support surface, which is preferably frusto-conical and is located at the top end of the lower cylindrical portion, corresponds to no more than the circumference of the lower cylindrical portion, while the bottom end of the upper cylindrical portion has radially outwardly directed, second support surface whose circumference is smaller than the circumference of the first support surface, a tube retaining ring, which can be slipped onto the upper cylindrical portion, being carried by the said second support surface.

Thus, although the tubes or bobbins mounted one above the other form a commonly transportable unit together with the carrier device, spatial separation is provided between the lower tube or bobbin, the annular or disc-shaped pull-off aid, and the upper tube or bobbin.

Preferably this separation between the two bobbins and the pull-off aid renders it possible to mount the pull-off aid so that it is rotatable, which, as tests have shown, leads to a desired reduction of the tension of a thread quided or deflected by mens of such pull-off aid.

In order to mount the bearing for the pull-off aid, the sleeve-shaped carrier member is preferably split up into lower and upper cylindrical portions which are interconnected by means of internal connection elements. For this purpose, preferably the top end of the lower cylindrical portion is provided with a spigot-like extension onto which the upper cylindrical portion can be slipped, preferably with a press fit or shrink fit, and preferably by means of internal sleeve located in the region of its bottom end. When the carrier member is subdivided into lower and upper cylindrical portions in this manner, the arrangement for rotatably mounting the pull-off aid can be mounted between these two cylindrical portions before the latter are united.

A bearing such as a ball bearing, for a hub member incorporating the first support surface is disposed preferably in the region of the bottom end of the upper cylindrical portion. Advantageously, the hub member is substantially in the form of an inverted cup whose base is provided with a central opening for slipping the hub member onto the spigot-like extension on the top of the lower cylindrical portion of the carrier member.

In a further preferred embodiment of the invention, the tube retaining ring for the upper tube or bobbin and the pull-off aid are equipped with mutually cooperating permanent magnet systems which effect magnetic attractive force between these two parts. When, in an arrangement of this latter kind, the pull-off aid is raised from its support surface and is removed upwardly, the tube retaining ring, which adheres to the pull-off aid as a result of the permanent magnet system, is also necessarily included in this operation, that is to say, as a result of the magnetic coupling thus provided the tube retaining ring and the pull-off aid remain joined together when removed from the carrier device, so that they can subsequently be commonly slipped onto the carrier member when reloading the carrier device with new bobbins or tubes. With respect to the effective magnetic forces, the mutually cooperating permanent magnet systems are designed such that, after the unit comprising the tube retaining ring and the pull-off aid held together by magnetic force, has been pushed onto the carrier device, the pull-off aid can be separated from the tube retaining ring again, so that free rotation of the pull-off aid is not impaired or prevented by the magnetic forces.

BRIEF DESCRIPTION OF DRAWINGS

The invention is described further hereinafter, by way of example only, with reference to the accompanying drawings, in which.

DETAILED DESCRIPTION OF A PREFERRED EMBODIMENT

Figure 1:
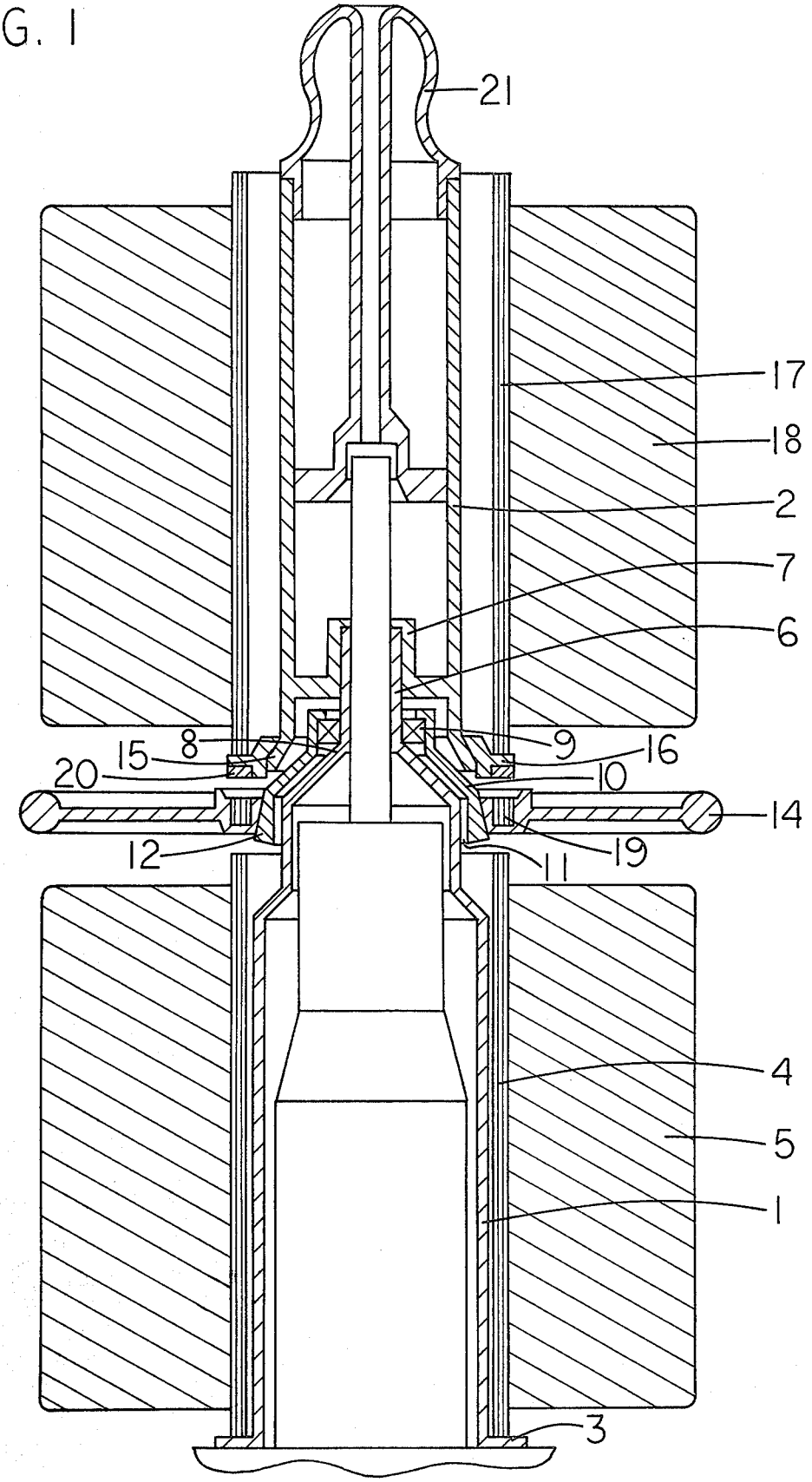
FIG. 1 is an axial section view through one embodiment of a carrier device in accordance with the invention, having two tubes or bobbins mounted one on the other.
Figure 2:
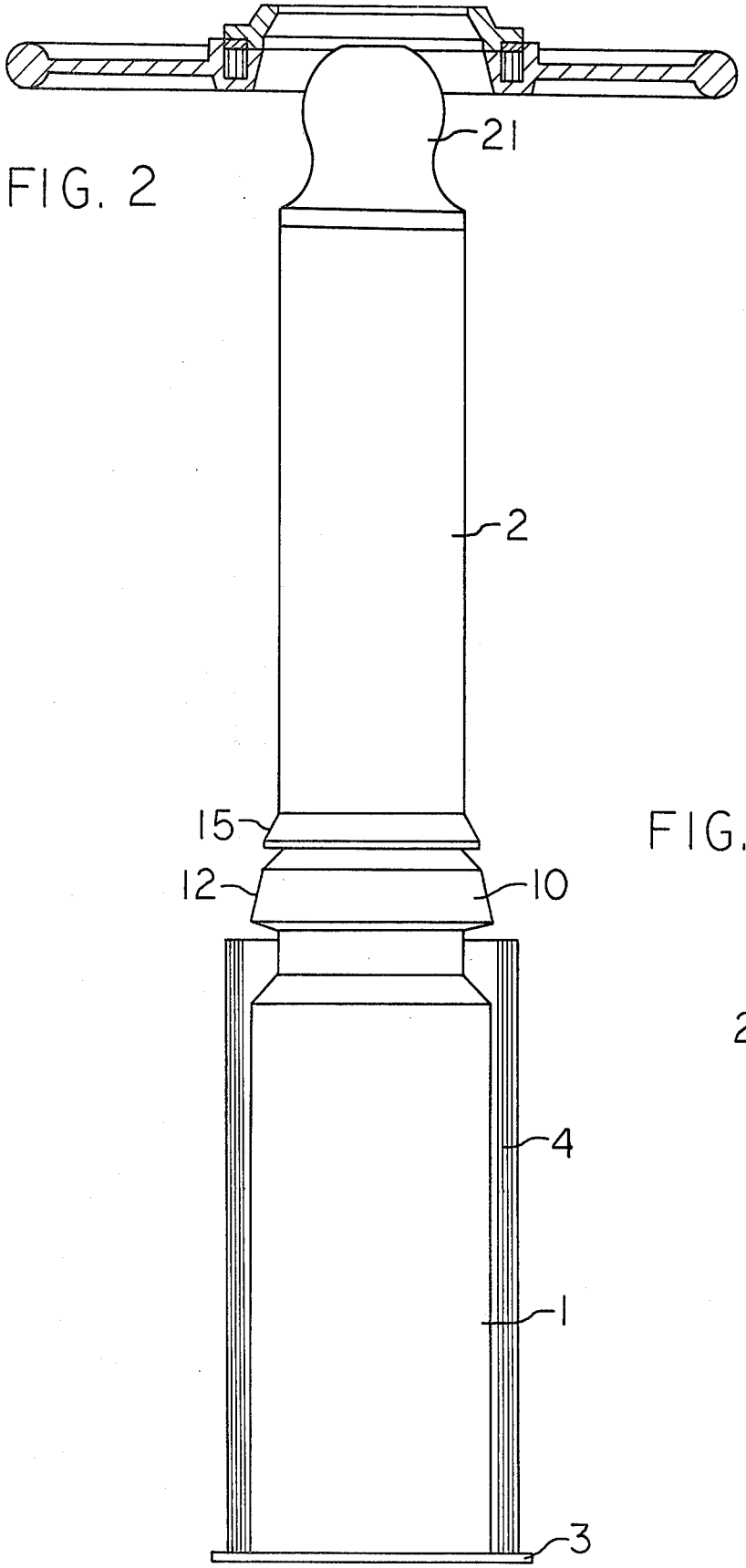
FIG. 2 shows the carrier device of FIG. 1 during assembly with the pull-off aid illustrated in sectional view.

The carrier device, illustrated in the drawings, for at least two twister or bobbin tubes placed axially one onto the other, comprises a substantially sleeve-shaped carrier member consisting of a lower cylindrical portion 1 and an upper cylindrical portion 2. The bottom end of the lower cylindrical portion 1 is provided with a radially outwardly directed support surface, preferably in the form of a flange ring 3, for a lower twister tube 4 or lower bobbin 5. The external diameter of the lower cylindrical portion 1 corresponds generally to the internal diameter of the twister tube 4 slipped onto the lower cylindrical portion. However, the top end of the lower cylindrical portion 1 has a plurality of steps of decreasing diameter which merge into a spigot-like extension 6 onto which the upper cylindrical portion 2 is slipped, preferably with a press or shrink fit, by means of an internal sleeve 7 located in the region of the bottom end of the upper cylindrical portion 2.

The top end region of the lower cylindrical portion 1 incorporates a location 8 for a ball bearing 9 which serves for rotatably mounting a substantially cup-shaped hub member 10. The bottom region of the hub member 10 is provided with a central opening 11 in order to be able to slip the hub member 10 over the spigot-like extension 6 before the lower and upper cylindrical portions are joined together.

Figure 3:
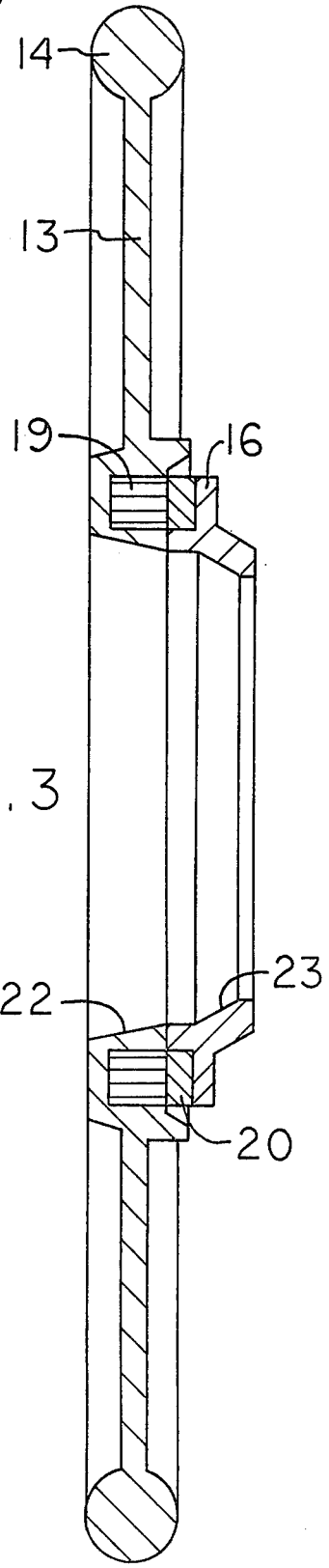
FIG. 3 is transverse sectional view to a larger scale through the assembly comprising the pull-off aid and the tube retaining ring.

The region of the downwardly directed, circularly symmetrical wall of the hub member 10 is formed with an external conical support surface 12 for an annular or disc-shape pull-off aid 13 whose external circumference has, for example, a circumferential bead 14 and which includes an internal conical and annular support surface 22, as illustrated in FIG. 3.

The support surface 12, located in the central region of the carrier member between the upper and lower cylindrical portions, has a circumference which corresponds to no more than the outer circumference of the lower cylindrical portion 1. The bottom end of the upper cylindrical portion 2 is provided with a radially outwardly directed, preferably annular and frusto-conical support 15 whose circumference is smaller than the circumference of the support surface 12. This support surface 15, which is preferably of annular configuration, serves to support a tube retaining ring 16, slipped onto the upper cylindrical portion 2, for supporting the upper twister tube 17 or upper bobbin 18. The tube retaining ring 16 is provided with a mounting surface 23 (FIG. 3) complementary to the annular support surface 15.

As a result of the foregoing configuration, a one-piece carrier member comprising upper and lower cylindrical portions is provided whose central region includes a freely rotatable pull-off aid disc whose mounting surface 22 is supported on a hub or conical member 10 in the form of the support surface 12, and which is connected by way of a stepped sleeve to the ball bearing 9 located on the top end or spigot-like extension 6 of the lower cylindrical portion 1 in the interior of the carrier device or of the carrier member.

As already mentioned, the upper cylindrical portion 2 which has a handle 21 for transporting the entire carrier device or, on the other hand, serves as a carrier for the upper bobbin 18, is rigidly connected to the lower cylindrical portion 1 by means of a shrink fit or press fit.

The tube retaining ring 16 for the upper bobbin 18 is a loose ring and is also supported on the conical holding surface of the annular support surface 15.

When the above described carrier device is reloaded, the upper bobbin 18 or the upper empty twister tube 17 is first removed upwardly. The rotatably mounted annular or disc-shaped pull-off aid 13 is then removed upwardly and thereby automatically lifts off the tube retaining ring 16 for the upper bobbin 18. To ensure that the take-off aid 13 and the tube retaining ring 16 remain together as a unit as illustrated in FIG. 3, the tube retaining ring 16 and the take-off aid 13 are equipped with mutually cooperating permanent magnet systems which effect a magnetic attractive force between these two parts. By way of example, several circumferentially distributed permanent magnets 19 are accommodated in the pull-off aid 13 and, in a opposed position relative thereto, a ferromagnetic steel ring 20 is provided on the underside of the tube retaining ring 16. By virtue of the magnetic coupling thus provided, the parts remain joined together when in the dissassembled state.

The bottom bobbin is then exchanged, and the carrier device is reloaded in the reverse sequence. The pull-off aid 13 and the tube retaining ring 16 will thereby be automatically separated from one another again when the tube retaining ring 16 has reached its conical support surface 15. The magnetic force of the permanent magnets 19, and the distance between the permanent magnets 19 and the steel ring 20 when in the assembled state, are dimensioned such that free rotation of the pull-off aid 13 is not obstructed by the magnetic force.

I claim:

1. A carrier device for at least two twister or bobbin tubes comprising; a substantially sleeve-shaped carrier member for carrying said tubes stacked axially one above the other, said carrier member having a central region, a first support surface on said central region, said central region having a circumference, the lower tube of said axially stacked tubes having an inner circumference such that the central region provided with a smaller circumference than the inner circumference of said lower twister tube enables the lower twister tube to be slipped onto said carrier member in an axial condition without disassembling, and an annular pull-off aid having a continuous circumferential thread engaging surface releasably supported on said first support surface.

2. A carrier device as claimed in claim 1, wherein said carrier member has a lower cylindrical portion and an upper cylindrical portion of smaller diameter than said lower cylindrical portion, and wherein said first support surface is located at the top end of said lower cylindrical portion and has a circumference which corresponds to no more than the circumference of said lower cylindrical portion, said upper cylindrical portion having a bottom end, said bottom end having a radially outwardly directed second support surface whose circumference is smaller than the circumference of said first support surface, and a tube retaining ring for slipping over the upper cylindrical portion so as to be carried by said second support surface.

3. A carrier device as claimed in claim 2, wherein the tube retaining ring and the pull-off aid have mutually cooperating permanent magnet systems which effect a magnetic attractive force between said tube retaining ring and said pull-off aid.

4. A carrier device as claimed in claim 2, wherein said first support surface is of frusto-conical configuration.

5. A carrier device as claimed in claim 2, wherein the upper and lower cylindrical portions have internal connection means for interconnection of said cylindrical portions.

6. A carrier device as claimed in claim 2 wherein said lower cylindrical portion has a top end spigot-like extension, said upper cylindrical portion having an internal sleeve in said bottom end to slidably receive said spigot-like extension.

7. A carrier device as claimed in claim 5, including internal connection means rigidly fitted together for attaching said upper and lower cylindrical portions together.

8. A carrier device as claimed in claim 1, and wherein said pull-off aid is rotatably mounted on said carrier member.

9. A carrier device as claimed in claim 8, and wherein said first support surface is defined by a hub member, a bearing member disposed in the region of the top end of said lower cylindrical portion tube of said carrier member, and said hub member is rotatably mounted on said bearing member.

10. A carrier device as claimed in claim 9, wherein said hub member is substantially in the form of an inverted cup having a base provided with a central opening.

* * * * *